US011375838B2

(12) United States Patent
Lindbo

(10) Patent No.: US 11,375,838 B2
(45) Date of Patent: Jul. 5, 2022

(54) MULTI-COMPARTMENT LOCKER

(71) Applicant: OCADO INNOVATION LIMITED, Hertfordshire (GB)

(72) Inventor: Lars Sverker Ture Lindbo, Hertfordshire (GB)

(73) Assignee: OCADO INNOVATION LIMITED, Hertfordshire (GB)

( * ) Notice: Subject to any disclaimer, the term of this patent is extended or adjusted under 35 U.S.C. 154(b) by 70 days.

(21) Appl. No.: 15/038,288

(22) PCT Filed: Nov. 21, 2014

(86) PCT No.: PCT/EP2014/075331
§ 371 (c)(1),
(2) Date: May 20, 2016

(87) PCT Pub. No.: WO2015/075205
PCT Pub. Date: May 28, 2015

(65) Prior Publication Data

US 2016/0286998 A1 Oct. 6, 2016

(30) Foreign Application Priority Data

Nov. 21, 2013 (GB) ..... 1320569

(51) Int. Cl.
*A47G 29/14* (2006.01)
*F25D 13/04* (2006.01)
(Continued)

(52) U.S. Cl.
CPC ..... *A47G 29/141* (2013.01); *F25D 13/04* (2013.01); *F25D 17/06* (2013.01); *F25D 17/08* (2013.01);
(Continued)

(58) Field of Classification Search
USPC ..... 237/1 R; 62/115, 448
See application file for complete search history.

(56) References Cited

U.S. PATENT DOCUMENTS 2,968,933 A * 1/1961 Pfeifer ..... F24F 1/04 62/126
3,545,223 A * 12/1970 Yngve ..... F25D 25/00 62/237
(Continued)

FOREIGN PATENT DOCUMENTS

FR 2 811 211 A1 1/2002
FR 2 830 524 A1 4/2003
(Continued)

OTHER PUBLICATIONS

International Search Report (PCT/ISA/210) dated Mar. 17, 2016, by the European Patent Office as the International Searching Authority for International Application No. PCT/EP2014/075331.
Written Opinion (PCT/ISA/237) dated Mar. 17, 2016, by the European Patent Office as the International Searching Authority for International Application No. PCT/EP2014/075331.

*Primary Examiner* — Steven B McAllister
*Assistant Examiner* — John E Bargero
(74) *Attorney, Agent, or Firm* — Buchanan Ingersoll & Rooney PC

(57) ABSTRACT

A locker for unattended storage and automated access of stored goods including a locker housing having at least one environmentally controlled compartment with an environmentally controlled access opening, an air inlet duct and an air outlet duct; a door sealingly engaging the environmentally controlled access opening; an automated latch engaging the door and movable between a locked position and an unlocked position; an access control unit in communication with the automated latch; and an environmental control unit removably housed in the locker housing, the environmental control unit having duct interfaces engagable with the air inlet duct and with the air outlet duct for circulating air
(Continued)

between the at least one environmentally controlled compartment and the environmental control unit, and the environmental control unit having an electric power connector engagable with an electric power outlet in the locker housing in communication with a source of electric power.

19 Claims, 5 Drawing Sheets

(51) Int. Cl.

| | |
|---|---|
| ***F25D 19/02*** | (2006.01) |
| ***F25D 17/06*** | (2006.01) |
| ***G07F 9/10*** | (2006.01) |
| ***G07F 11/62*** | (2006.01) |
| ***F25D 17/08*** | (2006.01) |
| ***F25D 29/00*** | (2006.01) |

(52) U.S. Cl.
CPC ..... *F25D 19/02* (2013.01); *F25D 29/00* (2013.01); *G07F 9/105* (2013.01); *G07F 11/62* (2013.01); *A47G 2029/147* (2013.01); *F25D 2400/04* (2013.01); *F25D 2400/40* (2013.01)

(56) References Cited

U.S. PATENT DOCUMENTS

| | | | | |
|---|---|---|---|---|
| 4,738,117 | A | 4/1988 | Takasugi | |
| 8,522,565 | B1 * | 9/2013 | Hauck | F25D 19/02 62/115 |
| 2004/0134221 | A1 * | 7/2004 | Fee | F25D 19/02 62/448 |
| 2006/0117763 | A1 * | 6/2006 | Espinosa | A47F 3/001 62/78 |
| 2006/0117789 | A1 * | 6/2006 | Yamasaki | F25D 19/00 62/448 |
| 2011/0083564 | A1 * | 4/2011 | Kirby | A47J 39/006 99/468 |
| 2011/0214942 | A1 * | 9/2011 | Niemiec | E04G 3/00 182/19 |

FOREIGN PATENT DOCUMENTS

| | | | |
|---|---|---|---|
| WO | WO 01/95773 | A1 | 12/2001 |
| WO | WO 2005/095876 | A1 | 10/2005 |

* cited by examiner

MULTI-COMPARTMENT LOCKER

FIELD

This disclosure relates to the field of multi-compartment lockers for unattended goods storage, and more particularly but not exclusively it relates to multi-compartment lockers with removable environmental control units.

BACKGROUND DISCUSSION

The delivery of goods is part of online sales that can involve unnecessary delays, theft, misplaced goods and added expense. While delivery to business premises is generally more reliable than delivery to an individual consumer at their home address, because at a business there is often a person in attendance during business hours to receive, handle and take responsibility for the goods, the requirement of such a person can drive up delivery costs. Home address or small business delivery can be unworkable when the recipient is frequently absent. Consequently, many delivery services include regional storage facilities or local retail store front premises to complete the delivery by requiring the recipient to attend personally to receive the goods after multiple delivery attempts that have failed. Small business customers may also prefer that the delivery of goods occur during non-business hours or without the distraction of working staff who have other responsibilities.

For the above and other reasons, the use of centralized automated lockers is increasing. The use of such lockers can, for example, reduce the cost of delivery, misplaced goods and delays. For example, such lockers can be used as a final stage in a "click and collect" online sales and delivery system, in which groceries and/or other goods are ordered on-line by the recipient (i.e.: the "click" portion) and are delivered to a nearby or otherwise convenient bank of automated secure lockers by the supplier, a courier company, or a shipping contractor. The recipient can be notified by email or text message that the goods are stored in a certain locker at a given location and an automated access code is provided. The recipient attends at the automated locker at their convenience within a prescribed time limit and "collects" the goods. If the goods are not "collected" within a prescribed time, the goods can be returned to the sender or otherwise removed from the click and collect locker which is intended form temporary storage only.

Click and collect systems can give a recipient customer more freedom to avoid waiting for a home or business delivery.

Delivery of foods or perishable goods can require multiple distinct temperature storage capabilities. For example, in a bank of automated lockers, it can be advantageous to provide for ambient temperature, refrigerated or chilled, and frozen storage. The installation and maintenance of refrigeration and/or freezing systems for use with perishable goods can be a significant cost item in storage and delivery processes. Maintaining such condition may require, for example, electric power, coolant installation and maintenance, temperature monitoring for food safety, defrosting, cleaning and attention to sanitary detail that may not be as critical for dry goods delivery.

Conventional automated storage lockers for perishable goods have storage compartments for refrigerated and/or frozen storage, with integrated refrigeration equipment. They typically comprise insulated compartments which house the compressor, condenser and the expansion valve in a hot compartment, and the evaporator in a cold compartment. These integrated units are generally large and bulky with additional hollow interior compartments for storing refrigerated/frozen goods. The compressor with electric motor, condenser, expansion valve, and evaporator are relatively heavy metal components built into an otherwise hollow lightweight insulated housing. The integrated design typically requires that conventional large and bulky click and collect locker units are manufactured in one facility, as a unit, and then shipped as a unit to the installed location. All repairs to the equipment of an integrated locker unit must be completed on location, unless the entire unit is removed and replaced. In a conventional storage locker, whenever any part of the coolant circuit is broken, the coolant ventilates to the atmosphere. In order to repair the unit to become operational again, the air in the system may need to be removed using a vacuum pump, new coolant can be injected afterwards, and the circuit may need to be re-sealed. This process may be cumbersome and cause operational inefficiencies as the storage locker may not be operational during this time, and further, repairs on location may not be as efficient as repairs at a specialized facility.

SUMMARY

The present disclosure provides an unattended refrigerated and/or frozen grocery delivery click and collect locker system that, in some example embodiments may, among other advantages, reduce the cost of manufacture, installation and/or maintenance, compared to conventional click and collect locker systems.

According to the invention there is provided a locker for unattended storage and automated access of stored goods comprising: a locker housing having at least one environmentally controlled compartment having an environmentally controlled access opening, an air inlet duct and an air outlet duct; a door sealingly engaging the environmentally controlled access opening; an automated latch engaging the door and movable between a locked position and an unlocked position; an access control unit in communication with the automated latch; and an environmental control unit removably housed in the locker housing, the environmental control unit having duct interfaces engagable with the air inlet duct and with the air outlet duct for circulating air between the at least one environmentally controlled compartment and the environmental control unit, and the environmental control unit having an electric power connector engagable with an electric power outlet in the locker housing in communication with a source of electric power.

In some embodiments, all of the active refrigeration/freezer components are mounted in a compact removable environmental control unit located under the storage compartments. The removable environmental control unit can be installed and removed for maintenance or exchange by single person by sliding into place on guides built into the locker housing. The environmental control unit can include slidably-engageable connections for connecting to an electric power supply, and slidably-engageable connections to the intake and output air ducts that supply the refrigerated or freezer compartments with circulating cold air. The locker housing and environmental control unit may include data communication to sense and control temperature, humidity and air flow circulation by a hard wired slidable connection or by wireless means. Cold air can be ducted from the removable environmental control unit and circulated into the frozen and refrigerated compartments. Warmer air can be circulated away from the compartments to a return duct to pass over the evaporator and be cooled. Ambient temperature compartments may be ventilated via passive ducting, or actively ventilated with ducting and fans which are integrated into the removable environmental control unit. Warm air from the condenser may be exhausted to ambient air outside the locker housing or may be circulated to heat the compartments in winter conditions. Air can be circulated by fans or blowers integrated into the air circuit of the removable environmental control unit.

In various embodiments, a single door can cover multiple compartments that are maintained at different temperatures since adequate seals and insulation are provided. The refrigerated or freezer compartment may include a drawer, to provide better access and minimize the build-up of frost in humid conditions.

The removable environmental control unit, which can for example include systems for refrigeration, freezing, heating, and/or humidity control, can be compact and may be manufactured on a large scale in a specialized facility at low cost for supply to a global market. The relatively large hollow bulky locker housing with storage compartments can be manufactured closer to the final installed location, providing lower transportation costs. Through standardization of the removable environmental control units, all maintenance on the removable units can be carried out under controlled conditions at a suitable repair location, rather than at the installed location. Better quality control and environmental protection can result since the release of refrigerant to the atmosphere can be significantly reduced, leading to lower greenhouse gas emissions during the life of the locker unit. In addition, if the locker unit is somehow damaged and needs replacing, the relatively expensive refrigeration unit can easily be salvaged.

BRIEF DESCRIPTION OF THE DRAWINGS

In order that the disclosure may be readily understood, embodiments of the disclosure are illustrated by way of example in the accompanying drawings.

Further details of the disclosure and its advantages will be apparent from the detailed description included below.

DETAILED DESCRIPTION

Figure 1:
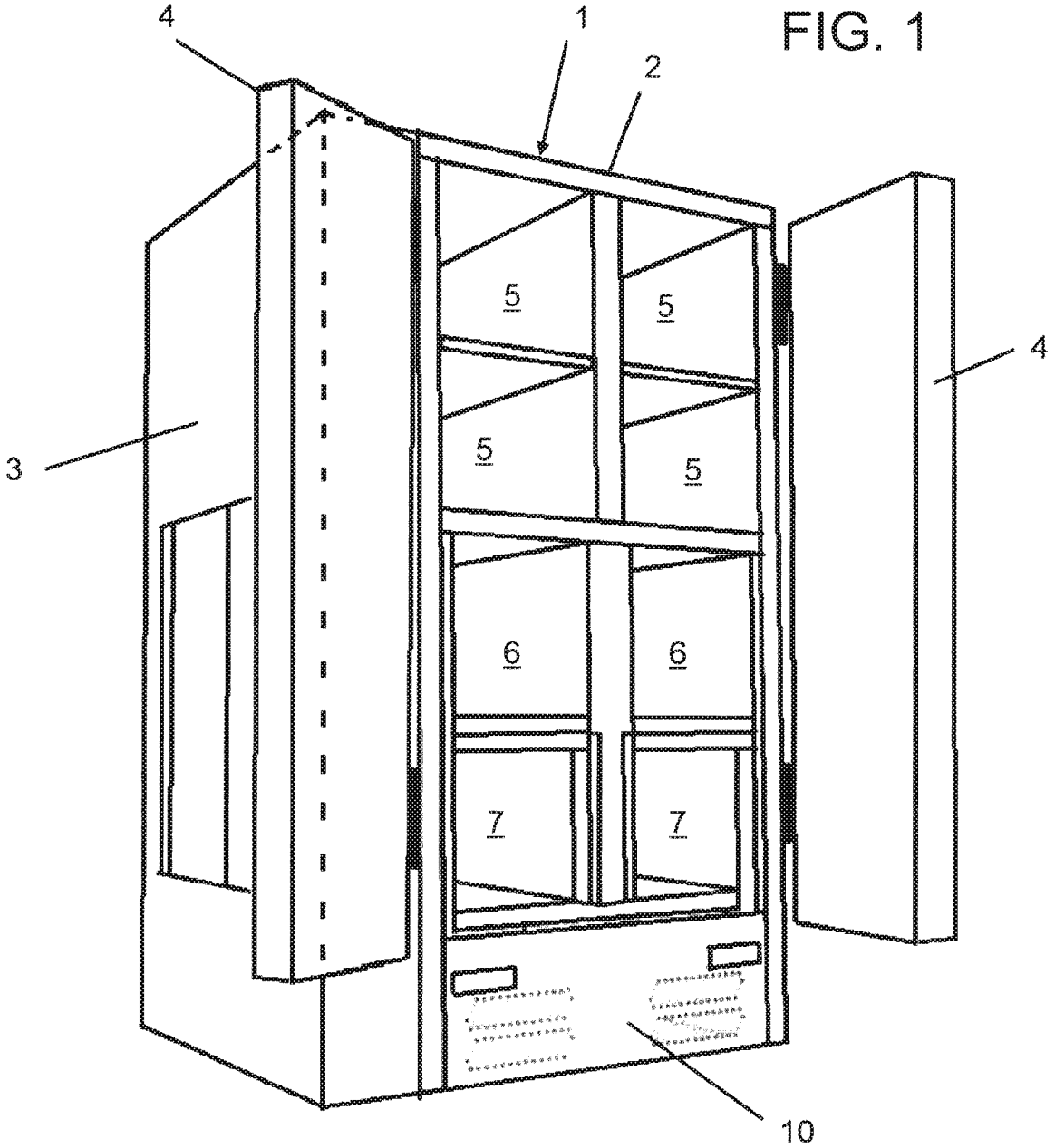
FIG. 1 is front left side view of a double door locker with two columns of four compartments, each column being sealed by a single door, an access control unit mounted to the left side and a removable environmental control unit slidably housed below the compartments.

FIG. 1 illustrates a locker 1 for unattended storage and automated access of stored goods (not shown) within compartments. The locker housing 2 can, for example, be constructed as a weatherproof sealable box or frame with weatherproof sheet metal cladding and lockable insulated doors 4. In FIG. 1 a single rectangular locker housing 2 is shown with two doors 4 and a single access control unit 3 mounted to the left side of the locker housing 2.

Figure 2:
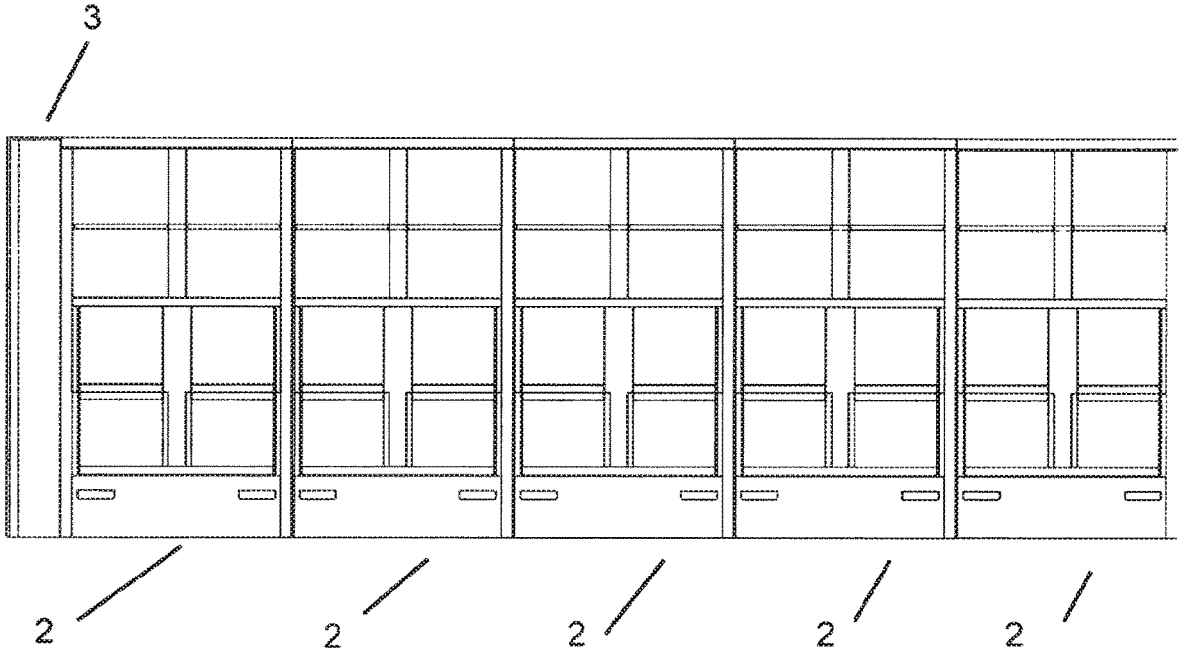
FIG. 2 is an elevation view of a bank, or array, of five double-door lockers joined together, with doors removed for clarity, where each locker has two columns of four compartments, an access control unit mounted to the left side of the array and a removable environmental control unit slidably housed below the compartments.

FIG. 2 shows an alternative array of five locker housings 2, which may for example be identical, with doors 4 removed for clarity, and a single access control unit 3 mounted to the left side of the leftmost locker housing 2. The locker housings 2 and access control units 3 are preferably manufactured separately as modules and can suit various installed arrangements. Alternatives that are not illustrated include: installing the access control unit 3 separately indoors and communicating wirelessly or with a hard wired connection with the locker housings 2; positioning the access control unit 3 in the middle of multiple locker housings 2; and positioning the access control unit 3 on the top surface of multiple locker housings 2. In some embodiments, the locker housings 2 may have ducts that may be interconnected ("cross ducting") or in otherwise fluid communication with one another. These ducts may contain various structural features that isolate and/or permit flow between one another. A potential advantage of such a configuration of ducts is the ability to pool cooling/heating capabilities of one or more environmental control units 10, especially where some of the one or more environmental control units 10 may be malfunctioning or otherwise not operating regularly. In some embodiments, one or more environmental control units 10 may be operated in tandem or otherwise synchronised in their cooling or heating capabilities.

The locker housings 2 in the accompanying drawings show two columns, each having four compartments 5, 6, 7, and 8 with doors 4 that sealingly cover each column. In the illustrated embodiments, four ambient compartments 5, two refrigerated compartments 6 and two freezer compartments 7 are provided, each having a front access opening to insert and remove goods. It will be understood that the any configuration can be provided depending on the needs of an installation.

The door 4 sealingly engages each access opening and is thermally insulated when covering the thermally insulated refrigerated and freezer compartments 6 and 7. An automated latch (not shown) engages the door and is movable between a locked position and an unlocked position when a lock/unlock signal is communicated from the access control unit 3.

Various embodiments of operations of the access control unit 3 and automated doors 4 suitable for use in implementing the disclosure are considered to be within the knowledge of the relevant art, and therefore are not described in detail herein.

Figure 3:
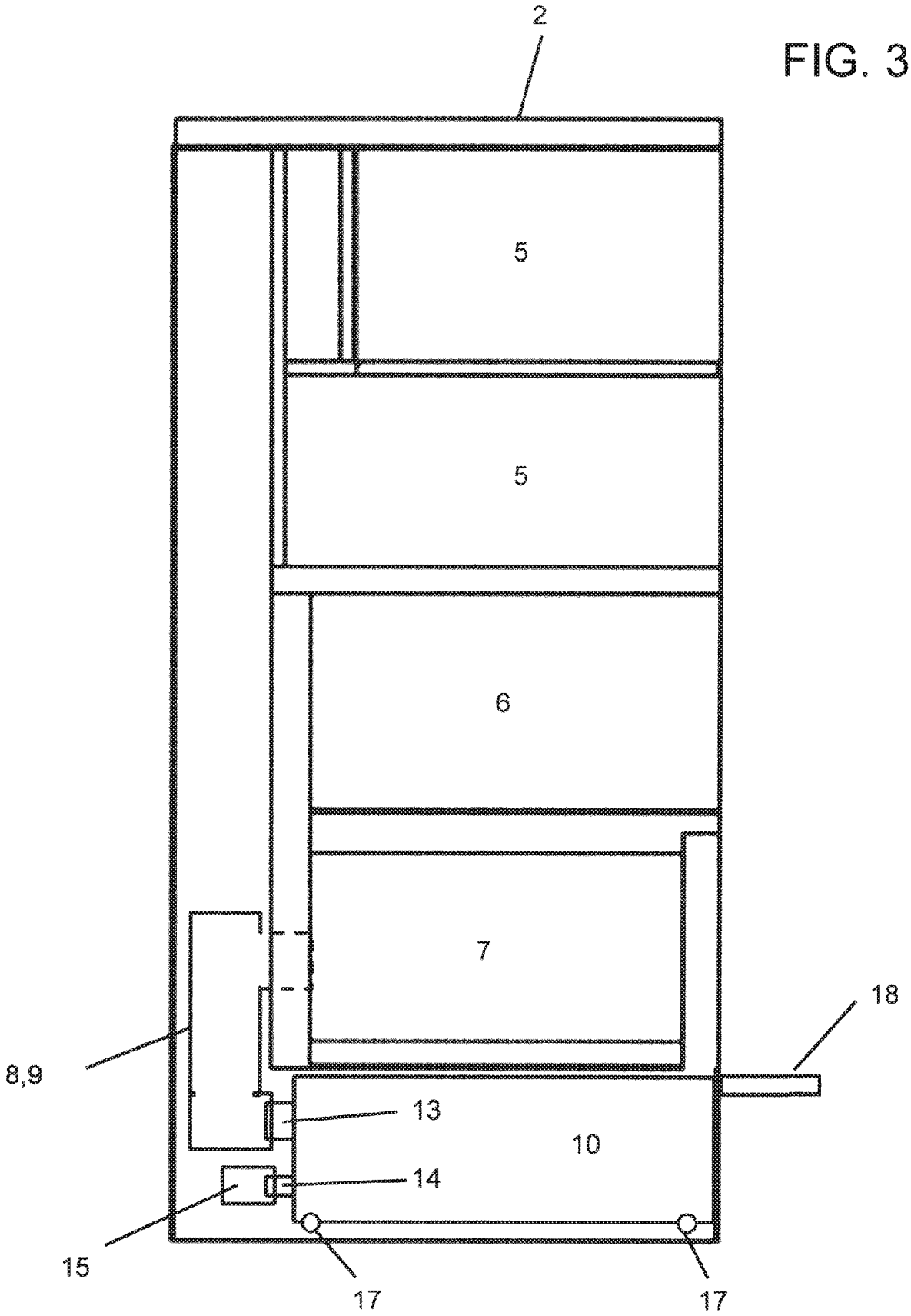
FIG. 3 is a vertical sectional view through a locker showing the lowest compartment as a freezer compartment with freezer ducts communicating with the removable environmental control unit.
Figure 4:
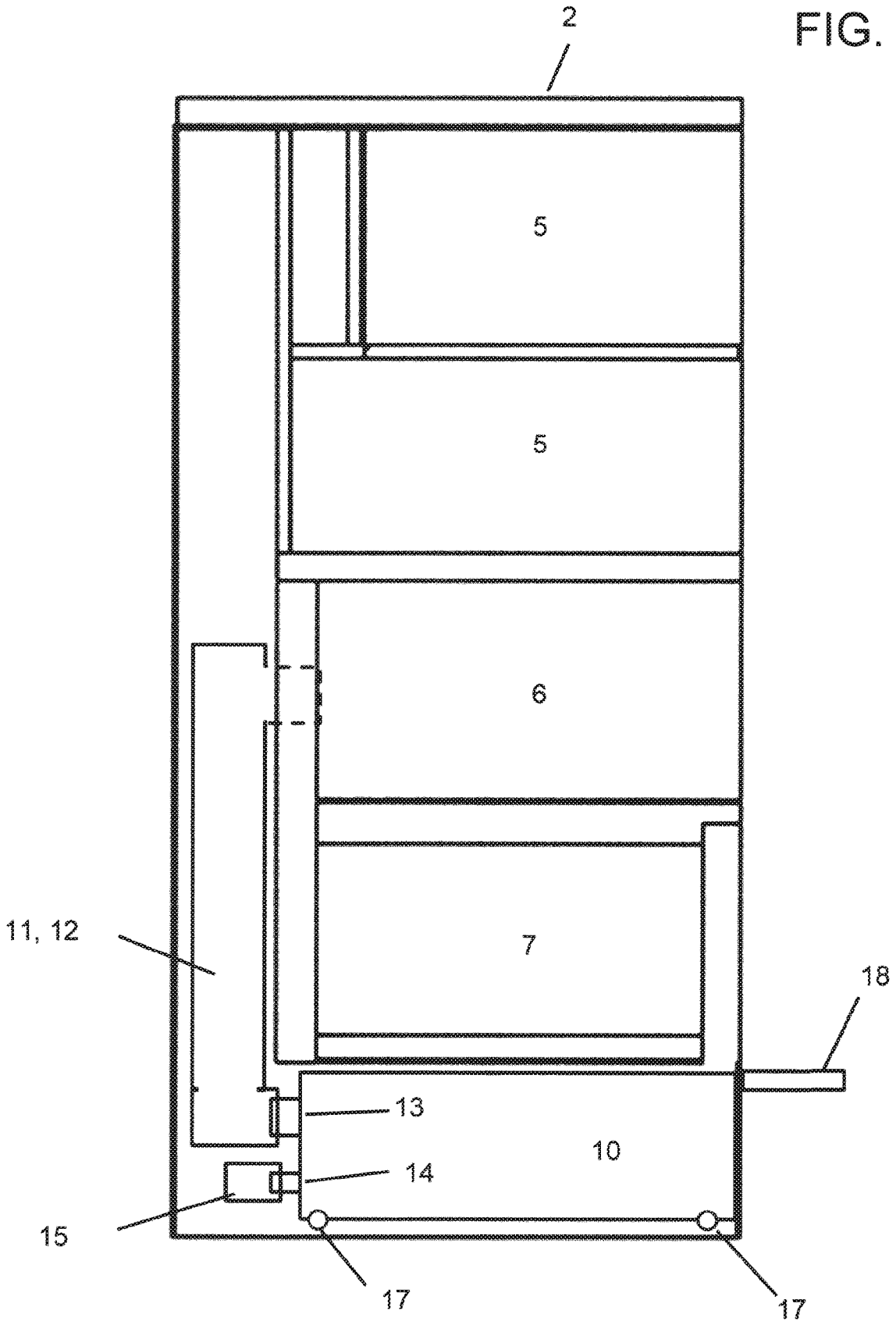
FIG. 4 is a vertical sectional view through a locker showing the second lowest compartment as a refrigerated compartment with refrigeration ducts communicating with the removable environmental control unit.

Common elements of all configurations can include a locker housing 2 having one or more environmentally controlled compartments, such as freezer compartments 7 and/or refrigerated compartments 6. As seen in sectional view of FIG. 3, each environmentally controlled freezer compartment 7 can include one or more freezer air inlet ducts 8 and/or freezer air outlet ducts 9 to circulate freezing air from the removable environmental control unit 10. In some embodiments, the environmentally controlled compartments 6 and 7 may also be utilized as regular, non-environmentally controlled compartments when the environmental control unit 10 is removed.

In some embodiments of the disclosure, refrigeration and/or freezer units can be housed in insulated plenum(s)

through which air is circulated. Air passing over the evaporator can be cooled, and the cool air can be ducted to the compartment that contains goods to be cooled or frozen. Warm air can be withdrawn from the compartment and recirculated to the evaporator through, for example, the use of return ducting and fans. Gas from the evaporator can be passed through the compressor again and the cycle repeated. Thus, for example, in such embodiments a removable environmental control unit 10 can include an evaporator within an air circulating plenum where the air within the freezer compartment 7 circulates through the plenum and evaporator via the ducts 8 and 9. As likewise seen in sectional view of FIG. 3 each environmentally controlled refrigerated compartment 6 has a refrigerated air inlet duct 11 and a refrigerated air outlet duct 12 to circulate refrigerating air from the removable environmental control unit 10. The removable environmental control unit 10 may include a separate evaporator within an air circulating plenum where the air within the refrigerated compartment 6 circulates through the plenum and evaporator via the ducts 11, 12. Alternatively, a single evaporator may be used to supply both compartments 6, 7 and the cold air is metered to each compartment 6, 7 to regulate the appropriate temperature desired.

Figure 5:
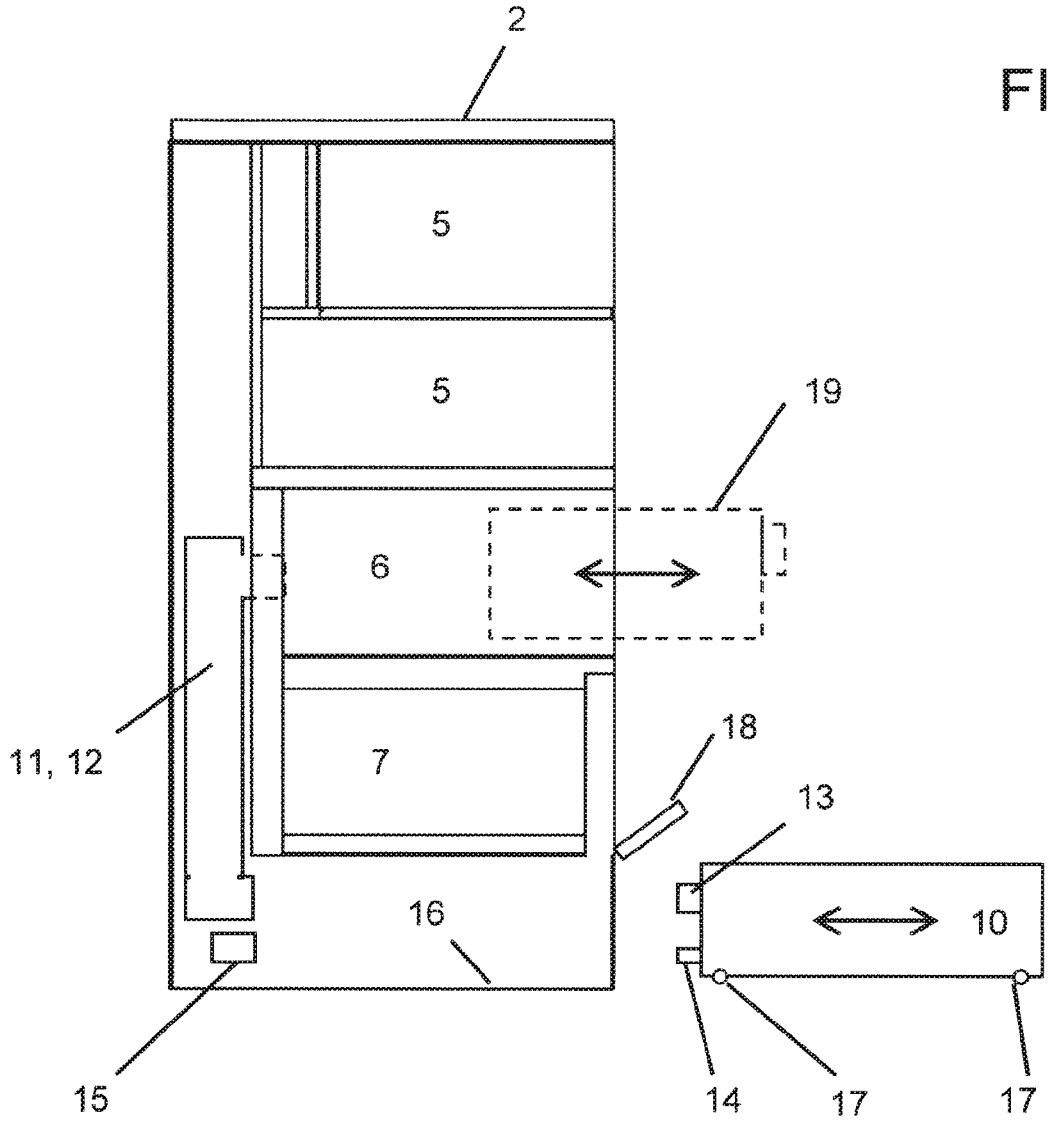
FIG. 5 is a vertical sectional view like FIG. 5 showing an optional drawer in dashed outline and showing the removable environmental control unit on wheels that run on guides in the locker housing with slidably-engageable or telescoping connections for the duct, and slidably-engageable electrical power supply connection.

As best seen in FIG. 5, environmental control unit 10, and or various components thereof, can be removably housed in a bottom portion of the locker housing 2 for efficient operation and maintenance, and for ease of access. For example, the relatively heavy compressor, evaporator, condenser, and expansion valve can advantageously be positioned near the base of the locker housing 2 for safe handling during removal, inspection and installation.

The environmental control unit 10 may be fully separable from the refrigerator compartments 6 and/or freezer compartments 7 of the locker housing 2. In some embodiments, a potential benefit to such a configuration is the ability to service the environmental control unit 10 without disturbing the operation of the goods stored in the refrigerator compartments 6 or freezer compartments 7. For example, a new environmental control unit 10 may be quickly swapped into the place of a malfunctioning environmental control unit 10. Similarly, in some embodiments, a potential benefit is the ability to service the environmental control unit 10 away from the refrigerator compartments 6, freezer compartments 7 and the locker housing 2, allowing the easy servicing of the environmental control unit 10 at a specialized facility.

These potential advantages may be commercially important in view of the differing maintenance requirements, costs and/or schedules associated with locker housings 2, and environmental control unit 10. The environmental control unit 10 may be a complex unit having a multitude of active parts, each having a different speed of wear and tear, and differing breakdown probabilities. The environmental control unit 10 may potentially have a greater likelihood of breakdown than a comparatively passive locker housing 2, and as such, may be subject to a rotating preventative maintenance schedule. A potential advantage to having an environmental control unit 10 that may be removable from the locker housing 2 without disturbing the contents of the refrigerator compartments 6 or freezer compartments 7 is that repairs and/or a rotating preventative maintenance schedule may be more readily achieved.

In the embodiment shown, the removable environmental control unit has slidably-engagable duct interfaces 13 engagable with the air inlet and air outlet ducts 11, 12 for circulating air between the refrigerated compartment 6 and the environmental control unit 10. Of course the freezer ducts 8, 9 can be engageable with similar sliding duct interfaces 13 seen telescopically sliding inside the ducts 8, 9 in FIG. 3. The removable environmental control unit 10 can also comprise one or more slidably-engagable electric power and/or signal or data interface connectors 14 engagable with mating outlets or connectors 15 in the locker housing 2 in communication with a source of electric power, control systems linked through compartment 3, etc. Upon engagement of the electrical interface connectors 14 to the mating outlets and/or connectors 15, the electronic circuit may be completed and electricity may flow through the environmental control unit 10.

The environmental control unit 10 can additionally or alternatively conduct heated air to a compartment if desired, for example in winter to prevent freezing of the goods, or to defrost a compartment. In such a case the environmental control unit 10 includes a heating unit or the heated air circulated over the condenser may be sufficient. Additionally or alternatively the environmental control unit 10 can include a humidity control unit such as a humidifier and/or dehumidifier, also in a circulating air circuit with the compartment and ducts. Further, the environmental control unit can include an exhaust vent and a fresh air intake, in circulation with a fan or other ventilation unit to ventilate a compartment and avoid excessive heat.

As seen in FIG. 5, the removable environmental control unit 10 preferably includes a supporting chassis for mounting the various components into a compact removable module. The bottom portion of the locker housing 2 includes guides 16 for moving the chassis on wheels 17 into and out of engagement with the locker housing 2. Simultaneously, the removable environmental control unit 10 is moved into and out of engagement with the air inlet duct 11, the air outlet duct 12 and electric power outlet 15. Preferably the duct interfaces 13 are in sliding, air-sealed engagement with the ducts 11, 12, and the electric power connector 14 is slidingly engagable with the electric power outlet 15 for ease of installation and removal. To sense the operation and control the environmental control unit 10, a sliding hard wired data interface and/or wireless data interface between the environmental control unit 10 and the locker housing 2 may also be provided for transferring data signals and control signals between the environmental control unit 10 and the locker housing 2.

In some embodiments, the duct interfaces 13 may be configured with various features to reduce leakage during engagement. For example, the duct interfaces 13 may include one-way valves, valves for controlling and/or redirecting flow, actuators, etc.

In some embodiments, the ducts 11, 12 and the power outlet 15 may be configured for convenient reinsertion and removal from the locker housing 2. Convenient reinsertion and removal of the ducts 11, 12 and/or the power outlet 15 may facilitate ease of cleaning, maintenance and/or relocation.

As seen in FIG. 5, the locker housing 2 can include an optional step 18 deployable beneath the door to allow users and operators to access higher compartments. Any compartment can also include an optional drawer 19.

In some embodiments, the environmental control unit 10 may be configured for convenient re-positioning, removal and/or insertion from the locker housing 2. The ease of re-positioning, removal and/or insertion may be a factor in achieving the commercial advantages associated with some embodiments. For example, features of the environmental control unit 10 may facilitate transportation between facilities, the ease of conducting maintenance, transportation within a facility, the ease of modification, the servicing of individual parts, troubleshooting, etc. Potential advantages thus include the ability to continue using a locker housing 2 with the environmental control unit 10 removed, the convenient transportation of environmental control units 10 to locations and/or other lockers where they may be more useful, or to easily replace a malfunctioning environmental control unit 10 with another environmental control unit 10.

There may be various structural features that may be incorporated into or otherwise associated with the locker housing 2, the environmental control unit 10, the freezer compartments 7, the refrigerated components 6, and the guides 16.

For example, there may be one or more longitudinal rails built into the locker housing 2 configured to receive the environmental control unit 10, and to guide the environmental control unit 10 into position. As a potential alternative to the wheels 17, longitudinal rails may be used to support the environmental control unit 10.

There may also be one or more fastening features, such as interlocking guides, tongue-and-groove features, snap-fit guides, hook and loop fasteners (e.g., Velcro™), magnetic guides, wing-nuts, dowels, cam-locks, latches, thumbscrews, screws, extrusions and/or protrusions that may be used to position the environmental control unit 10. The fastening features may also include various latching mechanisms that enable the secure fastening of the environmental control unit 10 with the locker housing 2. Various fastening features may be configured especially for hand-tightening and hand operation to allow an operator to easily remove, release, fasten and/or replace the environmental control unit 10.

There may be handles on the environmental control unit 10, or various types of features that allow for easy holding and/or controlled movement of the environmental control unit 10.

In some embodiments, individual components of the environmental control unit 10 may configured for convenient maintenance, repair, removal and/or reinsertion. For example, coolant circuits, the compressor, the evaporator, the condenser, etc., may be configured to be individually removable. Such a configuration may facilitate easy cleaning, maintenance and de-frosting of these components, which may be important for the continued operation, longevity of parts and maintaining a high efficiency of operation. For example, part of a coolant circuit may need to be replaced, coolant may need to be replaced, air entering a coolant circuit may need to be removed using a vacuum pump, and/or a coolant circuit may need re-sealing.

In some embodiments, there may be security features that may be configured to prevent tampering and/or otherwise unauthorized removal of the environmental control unit 10. Such security features may include tabs that rip upon tampering, magnetic/electronic connections that are configured to transmit a signal upon the breakage of a connection, etc.

In some embodiments, the environmental control unit and/or the locker housing may include one or more locking mechanisms which may be used to secure the environmental control unit in an engaged position in the locker housing 2. For example, the environmental control unit may include mechanical and/or electromagnetic lock(s). In some examples, magnetic forces between an electromagnet on the environmental control unit and an electromagnet or ferromagnetic portion of the locker housing can provide a force to guide and/or secure the environmental control unit into an engaged position whereby the various ducts and/or connectors are fully engaged. In some examples, the electromagnetic lock(s)'s magnetic field can be controlled (i.e. Enabled, disabled or varied in strength) by the one or more control systems. In some examples, the electromagnet can be proximate to the duct interface(s), electrical connector(s) or elsewhere on the locker housing or environmental control unit.

The environmental control unit 10 may include fastening features that may be configured for facilitating transportation on one or more conveying devices, such as a dolly, a hand truck, a forklift, a truck, etc. For example, the environmental control unit 10 may be configured with guide features that engage and/or otherwise mate with complementary features on conveying devices, such as the ability to engage with roof racks on cars, locking mechanisms for placement on trucks, cavities for forklift prongs to mate with, etc.

In some embodiments, the environmental control unit 10 may also have fastening features configured for engaging one another, facilitating secure storage and/or stacking of a plurality of environmental control units 10. For example, a number of environmental control units 10 may be loaded for transportation on a truck, stacked in a warehouse, etc., and it may be advantageous for the environmental control units 10 to be securely engaged with one another.

The locker housing 2 and/or the environmental control unit 10 may also include one or more control systems that are configured to provide various intelligent functionality, such as the automatic engaging of a latch, control of the locking of the environmental control unit, the automatic reporting of a door not being shut for a period of time, the automatic reporting of temperatures above/beyond a predefined range, the automatic reporting of an environmental control unit 10 not being properly disposed within a locker housing 2, the automatic reporting of the efficiency of operation of an environmental control unit 10, the automatic reporting of the sealing status of refrigerator compartments 6 and freezer compartments 7, the automatic tracking of maintenance schedules, the automatic reporting of maintenance problems, the automatic control of humidity, the automatic reporting of unauthorized access, and/or the automatic adjustment of temperatures based on predefined factors (e.g., season, external temperature, maximum power consumption).

The one or more control systems may be configured to receive commands and/or information from various external sources, and/or to have a predefined schedule and/or settings. The one or more control systems may be equipped with various sensors, such as magnetic sensors, electronic sensors, position sensors, accelerometers, gyroscopes, photo sensors, vibration sensors, acoustic sensors, temperature sensors, barometers, humidity sensors, etc.

In some embodiments, the one or more control systems may be configured to automatically adjust various features associated with the locker housing 2 and/or the environmental control unit 10. For example, where the outside temperature is expected to fall below freezing, the one or more control systems may be configured to automatically prepare a number of environmental control units 10 to initiate warming functions in anticipation of the requirements of customer orders. Conversely, where the outside temperature is high, a number of environmental control units 10 may initiate cooling functions in anticipation of higher demand for cooler compartments.

In some embodiments, the one or more control systems may be configured to automatically adjust various features based on the contents of items stored in refrigerator compartments 6 or freezer compartments 7. In some further embodiments, the one or more control systems may be configured to consider the heating/cooling effects of adding and/or removing items from the refrigerator compartments 6 or freezer compartments 7. For example, if a room-temperature item having a large thermal capacity is expected to be placed into a compartment, the environmental control unit 10 may adjust operations to increase cooling activities. A potential advantage to such an implementation is the reduction of the undesirable modification of temperatures of other objects placed in the refrigerator compartments 6 or freezer compartments 7.

In some embodiments, the environmental control unit 10 may be configured such that the environmental control unit 10, upon detecting, by an operator or automatically, that an environmental control unit is malfunctioning or otherwise not working properly, the environmental control unit 10 may be quickly swapped for a functioning environmental control unit 10. For example, if temperature sensitive goods are being stored in the refrigerator compartments 6 or freezer compartments 7, an environmental control unit 10 may be swapped quickly such that the temperature is maintained within an acceptable range during the transition. Accordingly, such 'quick swapping' functionality may be especially useful when the refrigerator compartments 6 or freezer compartments 7 are easily separable from the environmental control unit 10.

Although the above description relates to a specific preferred embodiment as presently contemplated by the inventor, it will be understood that the disclosure in its broad aspect includes mechanical and functional equivalents of the elements described herein.

The invention claimed is:

1. A locker for unattended storage and automated access of stored goods comprising:

a locker housing having at least one environmentally controlled compartment having an environmentally controlled access opening, an air inlet duct and an air outlet duct;

a door sealingly engaging the environmentally controlled access opening; and an environmental control unit removably housed in the locker housing, the environmental control unit having a first duct with a duct interface engagable with the air inlet duct and a second duct with a duct interface engagable with the air outlet duct for circulating air between the at least one environmentally controlled compartment and the environmental control unit, and the environmental control unit having an electric power connector engagable with an electric power outlet in the locker housing in communication with a source of electric power, wherein the environmental control unit includes a chassis, and the locker housing includes a guide for guiding the chassis into and out of engagement with the locker housing, the air inlet duct, the air outlet duct and electric power outlet, and wherein the first and second duct interfaces telescopically slide into respective contact with the air inlet duct and the air outlet duct such that the first and second duct interfaces are in respective sliding engagement with the air inlet duct, and with the air outlet duct.

2. The locker in accordance with claim 1, wherein the environmental control unit, when removed from the locker housing, is fully separated from the at least one environmentally controlled compartment.

3. The locker in accordance with claim 1, wherein removal of the environmental control unit from the locker housing includes disengaging the duct interfaces and the electric power connector, and separating the environmental control unit from the locker housing and the at least one associated environmentally controlled compartment.

4. The locker in accordance with claim 1, wherein the at least one environmentally controlled compartment and the door include thermal insulation.

5. The locker in accordance with claim 1, wherein the environmental control unit comprises a refrigeration unit.

6. The locker in accordance with claim 1, wherein the environmental control unit comprises a heating unit.

7. The locker in accordance with claim 1, wherein the environmental control unit comprises one of: a humidifier unit; and a dehumidifier unit.

8. The locker in accordance with claim 1, wherein the environmental control unit includes an exhaust vent and a fresh air intake, and wherein the environmental control unit comprises a ventilation unit.

9. The locker in accordance with claim 1, wherein the chassis and guide are disposed in sliding engagement.

10. The locker in accordance with claim 1, wherein the electric power connector is slidingly engagable with the electric power outlet.

11. The locker in accordance with claim 1 comprising:

at least one ambient compartment configured to be at an ambient temperature during an operation of the environmental control unit, the at least one ambient compartment including an ambient access opening, and a door sealingly engaging the ambient access opening and the environmentally controlled access opening.

12. The locker in accordance with claim 1, wherein the at least one environmentally controlled compartment comprises:

a refrigerated compartment with a refrigerated air inlet duct and a refrigerated air outlet duct;

a freezer compartment a freezer air inlet duct; and a freezer air outlet duct.

13. The locker in accordance with claim 1, wherein the at least one environmentally controlled compartment includes a drawer.

14. The locker in accordance with claim 1, wherein the locker housing includes an automated latch engaging the door and movable between a locked position and an unlocked position.

15. The locker in accordance with claim 14, wherein the locker housing includes an access control unit in communication with the automated latch.

16. The locker in accordance with claim 1, wherein at least one of the locker housing and the environmental control unit comprises an electromagnet which when active, secures the environmental control unit in an engaged position within the locker housing.

17. The locker in accordance with claim 1, wherein the locker housing includes a step deployable beneath the door.

18. The locker in accordance with claim 1, comprising:

a data interface between the environmental control unit and the locker housing for transferring one of: data signals; and control signals between the environmental control unit and the locker housing.

19. The locker in accordance with claim 1, wherein at least one of the first duct and the second duct include a valve for controlling air flow.

* * * * *